US007644822B2

(12) United States Patent
Elliott

(10) Patent No.: US 7,644,822 B2
(45) **Date of Patent: *Jan. 12, 2010**

(54) DISPENSING CONTAINERS

(75) Inventor: Howard Elliott, Oxfordshire (GB)

(73) Assignee: Future Technology (UK) Ltd, Oxfordshire (GB)

( * ) Notice: Subject to any disclaimer, the term of this patent is extended or adjusted under 35 U.S.C. 154(b) by 160 days.

This patent is subject to a terminal disclaimer.

(21) Appl. No.: 11/726,571

(22) Filed: Mar. 22, 2007

(65) Prior Publication Data

US 2008/0029424 A1 Feb. 7, 2008

Related U.S. Application Data

(63) Continuation-in-part of application No. 10/695,619, filed on Oct. 28, 2003, now Pat. No. 7,210,580.

(51) Int. Cl.
*B65D 17/34* (2006.01)

(52) U.S. Cl. ..... 206/538; 206/532

(58) Field of Classification Search ..... 206/531, 206/532, 538, 469, 461, 471, 484, 5.1, 484.2, 206/528; 220/359.2
See application file for complete search history.

(56) References Cited

U.S. PATENT DOCUMENTS 3,880,285 A * 4/1975 March ..... 206/373
3,924,748 A * 12/1975 Braverman ..... 206/534.1
4,294,361 A * 10/1981 Margulies et al. ..... 206/532
5,339,960 A * 8/1994 Price ..... 206/531

* cited by examiner

*Primary Examiner*—J. Gregory Pickett
(74) *Attorney, Agent, or Firm*—Kilyk & Bowersox, P.L.L.C.

(57) ABSTRACT

A container for storing and dispensing consumer products comprises a multi-compartment molded tray formed with an array of discrete cavities for receiving consumer products. A cover film is secured to the top surface of the tray to retain the item(s) within the cavities. The cover film has pre-formed tear lines defining peripheries of an array of tear-off portions, each tear-off portion arranged so that it overlies an associated cavity to retain the item(s) in that cavity. Each tear-off portion has an associated lug portion not secured to the tray in use, for gripping by a user before removing the tear-off portion. The top surface of the tray has an array of upwardly extending protrusions positioned to be located beneath the lug portions in use to bend those lug portions upwardly out of the plane of the remainder of the cover film to make the lugs readily graspable by a user.

27 Claims, 5 Drawing Sheets

DISPENSING CONTAINERS

CROSS-REFERENCE TO RELATED APPLICATIONS

This application is a Continuation-In-Part of U.S. patent application Ser. No. 10/695,619 (the "'619 application"), filed Oct. 28, 2003 and entitled "Dispensing Containers." The entire disclosure of the '619 application is hereby incorporated by reference herein in its entirety.

BACKGROUND OF THE INVENTION

The presently described invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules.

The containers may be used in place of conventional blister packs for the packaging of pills, tablets or capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

Blister packs are of course well known for the storage and dispensing of pills, tablets and capsules, which are stored individually in cavities in a multi-cavity tray and removed by pushing each pill, tablet or capsule through a rupturable film (that is, a film that is capable of being ruptured) or foil covering the cavities. The film or foil cover may be paper or a plastics film that can be peeled or torn away to expose the medication in the tray cavities, but is generally aluminium foil, which has the dual advantage of being easily rupturable and vapor-impermeable. Such blister packs normally carry only one unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7 or 5×7 array of cavities corresponding to 2, 3, 4 or 5 predefined medication times per day over a 7-day period, or one dose prescribed per day over a 2, 3, 4 or 5 week period. For example, a 4×7 tray may be filled with the medication to be taken at breakfast-time, lunchtime, early evening and immediately before retiring each day for a week, and then the filled cavities sealed with a rupturable or sequentially removable film or foil cover. Printed instructions on the pack identify the intended sequence of opening the individual cavities to dispense their contents according to the prescribed dosage regimen. Disadvantages of the above blister packs which use a rupturable foil cover sheet are the difficulty experienced by some patients, particularly the elderly, in pushing the medication through a foil cover sheet to rupture the cover sheet, the need for expensive laminating equipment to seal an aluminium foil cover sheet over the cavities after initial filling, and the difficulty experienced by the user in selecting the cavity containing the medication to be dispensed if the medication is pushed up through the foil from below. If the wrong cavity is opened, then re-sealing is impossible because the foil has ruptured.

A major disadvantage of the above blister pack using a peelable film cover sheet is the difficulty experienced by the user of peeling or tearing away a single selected portion of the cover sheet to expose the contents of only one preselected cavity. This can be achieved by scraping a finger-nail over a corner or tab portion of a segment of the cover sheet sealing the preselected cavity, but grasping that corner to peel away the complete segment sometimes requires considerable manual dexterity and possibly good eyesight, which may be beyond the abilities of many elderly consumers. Also, if a tacky peelable adhesive is used to adhere the cover sheet to the tray, it is desirable to prevent the contents of the tray from coming into contact with the adhesive. Finally, the film cover sheet may not have as high a vapor impermeability as metal foil, so there is a reluctance on the part of pharmacists to pre-fill a mixed medication blister pack with medication for administration more than seven days in advance of the filling date, lest the medication deteriorates due to storage in humid ambient conditions.

U.S. Pat. No. 4,294,361 to Margulies et al. discloses a dispensing container for storing and dispensing medication that includes a tray 10 having a generally planar top surface and one or more discrete cavities. A cover film 14 is secured to the top surface of the tray to seal the cavities. The cover film 14 is provided with pre-formed tear lines 20 and 26 that extend around three sides of each of an array of second cavities 18 but not around the discrete cavities 12 for containing the tablets or capsules. At the time when the cover film 14 is secured to the top surface of the tray 10, the second cavities 18 are in the position shown in FIG. 2 where they extend away from the cover film 14 on the same side of the top surface as the discrete cavities 12. The second cavities 18 are collapsible and can be manually inverted by a consumer to the position shown in FIG. 3 of Margulies et al. to rupture the cover film 14 along the tear lines 20 and 26. This forms a lug portion 22 that can be grasped and then used to remove the part of the cover film that overlies the associated cavity 12. The purpose of Margulies et al. is therefore to provide a dispensing container that incorporates features to make it difficult for children to gain access to the medication. However, the need for the second cavities 18 to be manually inverted by the consumer before the medication can be properly dispensed means that the dispensing container of Margulies et al. suffers from the same disadvantages as the conventional blister packs mentioned above, namely it requires considerable manual dexterity that may be beyond the abilities of many elderly consumers.

Prepared meals are commonly sold in packaging containers comprising a heat resistant tray and an open-ended sleeve made of a suitable food grade boxboard. The tray is normally sealed with a peelable film or foil cover. A major disadvantage of these packaging containers is the difficulty which consumers can experience when trying to remove the cover. The difficulties are particularly acute if the prepared meal has been heated and the packaging container is hot.

BRIEF SUMMARY OF THE INVENTION

Embodiments of the presently described invention aim to remove some or all of the above problems and disadvantages. For example, an embodiment of the presently described invention provides a container for storing and dispensing consumer products, comprising a tray having a generally planar top surface into which has been formed one or more discrete cavities for receiving the consumer products and a cover film to be secured to the generally planar top surface of the tray to seal the one or more cavities to retain the consumer products in the one or more cavities, where the cover film has pre-formed tear lines defining a tear-off portion corresponding to the periphery of one or more cavities to retain the consumer products in the respective cavity until the tear-off portion is removed by tearing along its tear lines, the respective tear-off portion of the cover film having a respective associated lug portion not secured to the tray in use for gripping by a consumer preparatory to tearing off the respective tear-off portion, and where the top surface of the tray has a rigid upwardly extending protrusion positioned to be located underneath the respective lug portion in use to bend that lug portion upwardly out of the plane of the remainder of the cover film when the cover film is secured to the generally planar top surface of the tray to retain the consumer products in the one or more cavities.

Because the or each lug portion is bent up out of the plane of the remainder of the cover film when the film is stuck down, it can very easily be grasped by the consumer for removal of the tear-off portion. This makes it easier for elderly consumers to use the dispensing container.

The cover film is preferably secured to the generally planar top surface of the tray by an adhesive. The adhesive may be a co-adhesive, a pressure contact adhesive, a peelable adhesive or a heat sensitive lacquer, the latter being utilized in a heat-sealing process.

The cover film may be a metal foil, such as aluminium foil, a metallized polymeric film or paper sheet, or a plastics film of single or multiple layer constructions depending on the sort of consumer products to be stored and dispensed from the container. The cover film is preferably non-rupturable so that it becomes more difficult to accidentally or deliberately push the consumer products through the cover film.

The periphery of each tear-off portion may be defined by pre-scored tear lines, pre-perforated tear lines, or cut lines extending completely through the material of the cover film around the whole of the periphery of the tear-off portion, or any combination thereof. The pre-scored tear lines may be created by pressing a knife on to the surface of the cover film so as to cut or score part way through but not fully through the thickness of the cover film.

The depth of the pre-scored tear lines or the size and shape of the individual perforations of the pre-perforated tear lines can be determined to provide the right amount of resistance to separation for any given application. Increasing the resistance to separation can reduce the likelihood of the tear-off portions being removed accidentally or being pushed into the discrete cavities if, for example, the dispensing containers are stacked one on top of the other. The pre-scored tear lines, pre-perforated tear lines and cut lines can be formed using a rotary die cutter or the like.

The periphery of each tear-off portion will generally correspond to the periphery of the one or more cavities, but may also lie within the periphery of the one or more cavities in such a way that each tear-off portion is smaller than the associated cavity. The periphery of each tear-off portion may also lie outside the periphery of the one or more cavities in such a way that each tear-off portion is larger than the associated cavity.

The respective lug portion of the tear-off portion can be defined by cut lines extending completely through the material of the cover film around the whole of the periphery of the or each lug portion except for a hinged portion connecting that lug portion to its associated tear-off portion. Then when the cover film is secured to the top surface of the tray, the respective lug portion bends upwardly out of the plane of the remainder of the cover film by pivotal flexure about the hinged portion. If the respective lug portion is defined by pre-scored tear lines or pre-perforated tear lines instead of cut lines then when the cover film is secured to the top surface of the tray, the pre-scored tear lines or pre-perforated tear lines are broken by the rigid upwardly extending protrusion and the respective lug portion bends upwardly out of the plane of the remainder of the cover film by pivotal flexure about the hinged portion.

If the container is a multi-compartment container used to organise and store mixed medication for subsequent dispensation according to a predefined dosage regimen, then the cover film or the tray (if the cover film is transparent) is preferably printed with details of the sequence of the dosage regimen so a user can determine the correct sequence of opening and can peel away the individual tear-off portions from above, thereby leaving the medication safely contained in its tray cavity until the opened cavity is inverted to tip out the medication. The individual tear-off portions of the cover film can be removed with the generally planar top of the tray facing upwards, so that the risk of spilling the medication onto the floor during opening is much reduced over rupturable foil covered blister packs, which are generally opened in the inverted position.

At least the tear-off portions of the cover film preferably have low vapor-permeability so the medication temporarily encapsulated in the different discrete cavities can be protected from variations in ambient humidity during storage of the medication within the container. Low vapor permeability is also important if the container is used to store and dispense consumer products such as foods or electronic components that can perish or suffer damage if too much moisture is allowed to enter the discrete cavities through the cover film.

The tear-off portions of the cover film may be made selectively of low vapor permeability in the areas that overlie the cavities, by adhering to the bottom of the cover film patches of material (so-called "vapor-resistant patches") with high vapor barrier properties, shaped and sized to overlie the cavities. In the same way, patches of material (so-called "lug reinforcement patches") can be adhered to the bottom of the lug portions to reinforce the rigidity of the lug portions and to prevent or reduce the incidence of adhesive applied to the underside of those lug portions causing the lug portions to adhere to the upwardly extending protrusions of the tray. The patches beneath the tear-off portions and the lug portions can be created from a single sheet of barrier film as follows. A single sheet of that barrier film can be secured to the underside of the cover film by a peelable adhesive. The barrier film has pre-formed tear lines defining the peripheries of the vapor-resistant patches and the lug reinforcement patches, so that peeling away the majority of the barrier film from the cover film immediately prior to application of the cover film to secure it to the generally planar top surface of the tray exposes the peelable adhesive in areas necessary for adhesion to the tray, but leaves the patches attached elsewhere to the underside of the cover film. The barrier film may be a metal foil, a metallised polymeric film or paper sheet, or a plastics film of single or multiple layer construction that is preferably chosen for its high vapor barrier properties. In very general terms the vapor permeability of any particular sheet or film is inversely proportional to its thickness. It will therefore be realised that the vapor-resistant patches have the inherent effect of reducing vapor permeability because they increase the overall thickness of the cover film in the regions that in use overlie the cavities. This effect will be in addition to any specific vapor barrier properties that are provided by the material from which the barrier film is formed.

The pre-formed tear-lines in the barrier film defining the peripheries of the vapor-resistant patches may be pre-scored tear lines or pre-perforated tear lines. The pre-scored tear lines may be created by pressing a knife on to the surface of the cover film so as to cut or score part way through but not fully through the thickness of the cover film. The pre-formed tear-lines in the barrier film may also be defined by cut lines extending completely through the material of the barrier film around the whole of the periphery of the respective vapor-resistant patches. The pre-scored tear lines, pre-perforated tear lines and cut lines can be formed using a rotary die cutter or the like. The peripheries of the vapor-resistant patches may also be defined by any combination of pre-scored tear lines, pre-perforated tear lines and cut lines.

In the case where the vapor-resistant patches and the lug reinforcement patches are created from a single sheet of barrier film, the pre-formed tear lines in the cover film and the barrier film are preferably formed after the cover film and the barrier film have been adhered together. If the peripheries of the tear-off portions are defined by pre-perforated tear lines or cut lines, then they (that is, in the former case the individual perforations) can extend through the cover film, the peelable adhesive layer and partly into the barrier layer. However, care must be taken not to substantially weaken the integrity of vapor-resistant patches. It is generally preferred that if the peripheries of the vapor-resistant patches and the lug reinforcement patches are defined by pre-perforated tear lines or cut lines, then they (that is, in the former case the individual perforations) extend through the barrier film and the peelable adhesive layer but not into the cover film.

In a preferred embodiment of the invention, the pre-formed tear lines defining the peripheries of the vapor-resistant patches lie outside the pre-formed tear lines defining the peripheries of the array of tear-off portions such that the vapor-resistant patches are larger than the tear-off portions. The vapor-resistant patches may overly a narrow border of the generally planar top surface of the tray surrounding the associated cavity. In the preferred embodiment the pre-formed tear lines in the cover film and the pre-formed tear lines in the barrier film are not coincident with each other. The tear lines in the cover film can therefore be defined by cut lines extending completely through the material of the cover film around the whole of the periphery of the tear-off portions. This means that there is no physical connection between the periphery of the individual tear-off portions and the remainder of the cover film. Each individual tear-off portion will normally be held in position within the plane of the remainder of the cover film by the associated vapor-resistant patch to which it is adhered. The associated vapor-resistant patch is larger than the tear-off portion and is adhered to a narrow border of the cover film immediately outside the cut line in the cover film. The associated vapor-resistant patch can then be peeled away from this narrow border of the cover film when the tear-off portion is removed.

Each lug reinforcement patch is connected to its associated vapor-resistant patch by a bridge portion so that when the cover film is secured to the top surface of the tray, the lug reinforcement patches bend upwardly out of the plane of the vapor-resistant patches by pivotal flexure about the bridge portions when they are forced into contact with the rigid upwardly extending protrusions. By grasping a lug portion and its associated lug reinforcement patch, the user can remove a tear-off portion and its associated vapor-resistant patch in a single action so that the item stored in the cavity can be dispensed. The preferred embodiment described above incorporates tamper-evident properties because once a tear-off portion of the cover film has been removed to expose the contents of the cavity, it cannot be reattached to the remainder of the cover film. This is because the vapor-resistant patch is larger than the tear-off portion to which it is adhered and it cannot be easily inserted back through the opening in the cover film that is created when the tear-off portion is removed. In the case where the vapor resistant patch overlies the generally planar top surface of the tray, it will be readily appreciated that when a tear-off portion and its associated vapor resistant patch have been removed, there will be a narrow border of the cover film immediately outside the pre-formed tear line defining the periphery of the tear-off portion, which was previously adhered to the said associated vapor-resistant patch. In practice, because the underside of the cover film is covered with a peelable adhesive, the narrow border will tend to secure itself to the generally planar top surface of the tray. This makes it almost impossible to slide the whole of the periphery of the vapor-resistant patch back between the cover film and the tray. Tamper evident properties are especially important if the container is used to store and dispense medication or food.

Although the above description has focused exclusively on vapor permeability it will be recognised that the tear-off portions of the cover film may be provided with other selected barrier properties. For example, if the consumer products in the cavities are sensitive to light then one or both of the cover film and the barrier film can have light barrier properties to reduce or prevent the transmission of light. Some consumer products such as electronic components may be sensitive to atmospheric gases such as oxygen. The tear-off portions of the cover film may therefore be made selectively of low oxygen permeability in the areas which in use overlie the cavities by using a barrier film that has high oxygen barrier properties.

The cover film may include patches shaped and sized to overlie the cavities and adhered to the underside of the cover film by the same layer of peelable adhesive as that which in use adheres the cover film to the top surface of the tray. These patches do not necessarily have to provide barrier properties and may be simply used to prevent the contents of the discrete cavities from coming into contact with the peelable adhesive on the underside of the cover film. The patches may be made of a metal foil, a metallised polymeric film or paper sheet, or a plastics film of single or multiple layer construction, for example. The patches may be formed from a separate backing sheet in the same way as the vapor-barrier patches described above. The patches may also be sized and shaped relative to the tear-off portions of the cover film and the one or more cavities of the tray in the same way as the vapor-barrier patches described above. In other words, the pre-formed tear lines defining the peripheries of the patches may lie outside the pre-formed tear lines defining the peripheries of the array of tear-off portions such that the patches are larger than the tear-off portions.

The cover film can be secured to the tray using an industrial process. A typical process might involve securing the cover film to the tray using a high-speed, on-line heat or cold seal technique of the kind used to secure the rupturable film or foil to conventional blister packs. The generally planar surface of the tray could then be rolled to push the lug portions down onto the array of upwardly extending protrusions and bend those lug portions upwardly out of the plane of the remainder of the cover film. The rolling can be mechanical or by means of a hand roller, for example.

The upwardly extending protrusions are preferably formed in the generally planar top surface of the tray during a molding process. They are rigid and remain fixed in a stationary position above the top surface of the tray as the cover film is secured to the tray to retain the consumer products in the one or more cavities. In practice, it will be appreciated that the protrusions must be sufficiently rigid to prevent them from being inverted or collapsed by the forces that are applied to the tray as the cover film is secured in position.

Figure 1:
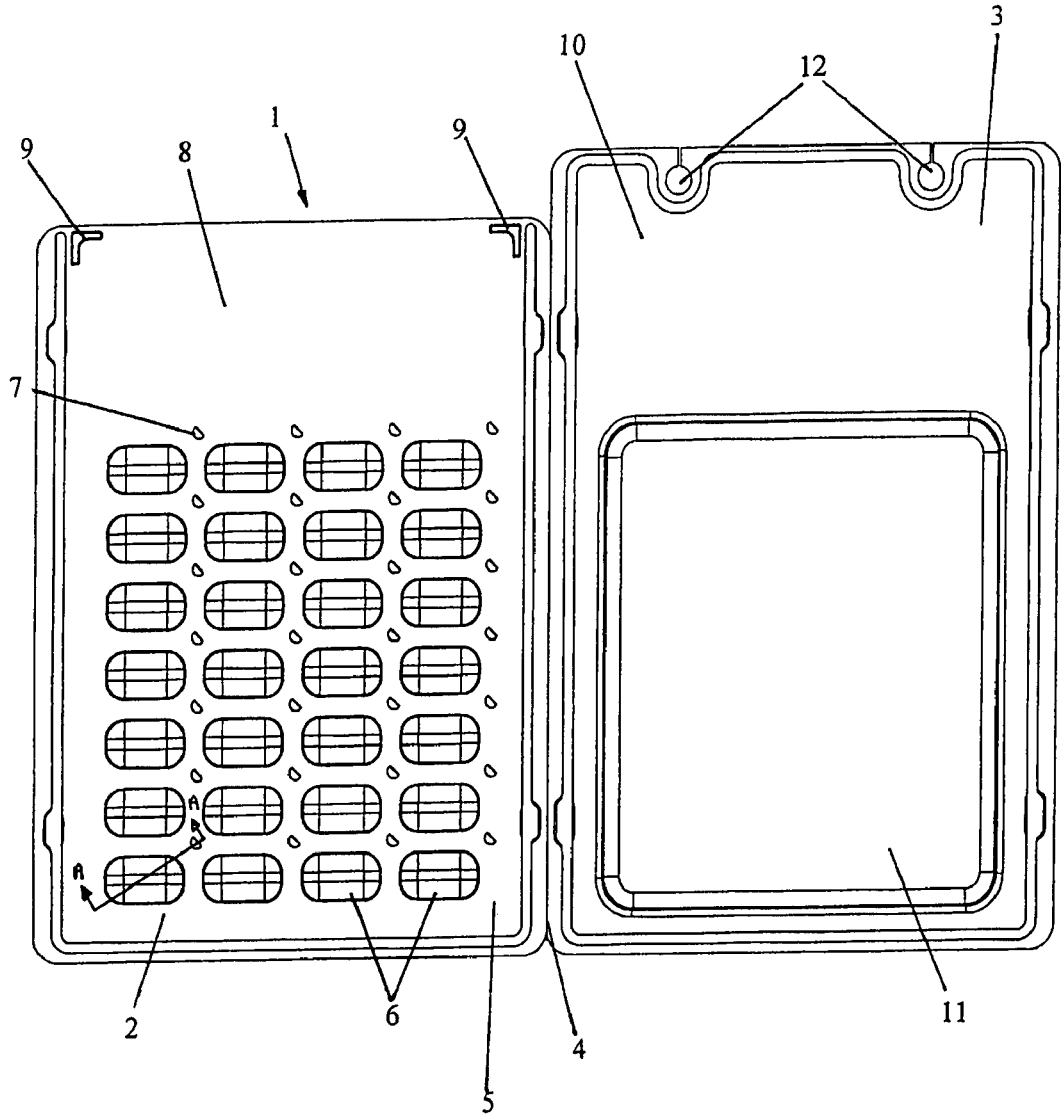
FIG. 1 illustrates a top view of a molded tray of a multiple-compartment container in accordance with an embodiment of the presently described invention.

The foregoing summary, as well as the following detailed description of certain embodiments of the presently described invention, will be better understood when read in conjunction with the appended drawings. For the purpose of illustrating the presently described invention, certain embodiments are shown in the drawings. It should be understood, however, that the presently described invention is not limited to the arrangements and instrumentality shown in the attached drawings.

DETAILED DESCRIPTION OF THE INVENTION

Although the container according to embodiments of the presently described invention can be suitable for storing and dispensing a wide range of consumer products, the rest of the specification will concentrate mainly on its use as a multi-compartment container for organizing and storing mixed medication for subsequent dispensation according to a predefined dosage regimen. Therefore, all embodiments of the presently described invention are not limited to a multi-compartment container for organizing and storing mixed medication for subsequent dispensation according to a predefined dosage regimen.

Figure 2:
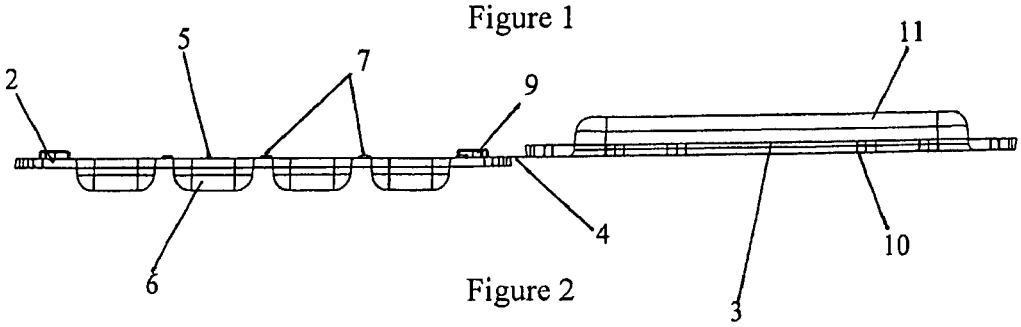
FIG. 2 illustrates a front elevation view of the tray of FIG. 1 in accordance with an embodiment of the presently described invention.

Referring first to FIGS. 1 and 2, there is illustrated a molded tray 1 for use in the creation of a multiple-compartment container according to an embodiment of the presently described invention. The tray 1 is formed from a sheet of thermoplastic material, and may be formed for example by press molding or by vacuum molding.

The tray 1 is formed from an upper part 2 and a lower part 3 joined together by an integrally molded hinge 4. The upper part 2 comprises a generally planar top surface 5 (see FIG. 2) into which has been formed a 4×7 array of discrete cavities 6. It will be readily appreciated that other arrangements of the discrete cavities are possible depending on the particular dosage regimen required.

Figure 6:
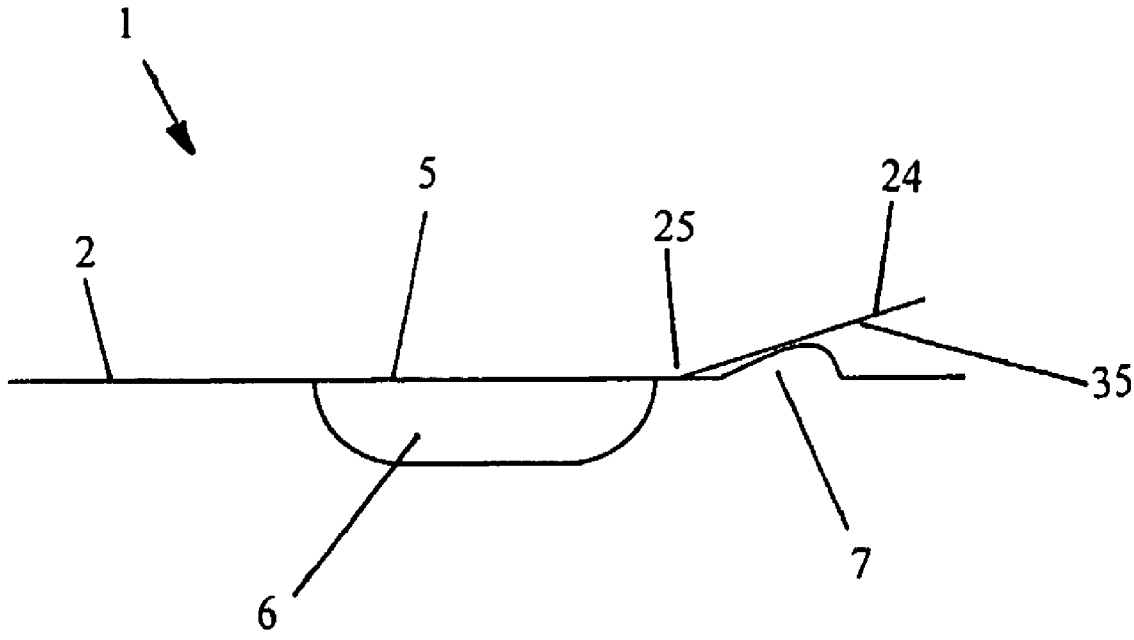
FIG. 6 illustrates a cross-sectional view taken along the line A-A in FIG. 1 with the cover sheet and barrier sheet of FIGS. 3 to 5 applied to the top surface of the tray in accordance with an embodiment of the presently described invention.

Upstanding from the generally planar top surface 5 of the upper part 2 is a 4×7 array of rigid upwardly extending protrusions 7, each positioned above and to the right of an associated cavity 6 as viewed in FIG. 1. Each protrusion 7 is fixed in position and slopes upwardly from the plane of the top surface 5 in a direction away from the associated cavity 6 as shown in FIG. 6. Each protrusion 7 is generally semi-circular in plan view as shown in FIG. 1.

A flat header portion 8 of the upper part 1 immediately above the array of cavities 6 and protrusions 7 is provided for receiving printed information such as a trademark or a pharmacy label. Close to the top corners of the header portion 8 the upper part of the tray is provided with two upstanding integrally molded location brackets 9 for the accurate location of a cover sheet in register with the cavities 6 and protrusions 7.

The lower part 3 comprises a generally planar surface 10 (see FIG. 2) into which has been formed a single cavity 11. Two split apertures 12 are provided in the top edge of the lower part 3 so that the tray can be clipped onto a U-shaped wire loop and stacked with other trays prior to the medication being dispensed. In use, the tray 1 is assembled by folding it along the hinge 4 so that the lower part 3 and the upper part 2 come into register on top of each other and the array of cavities 6 formed in the generally planar top surface 5 are received within the single cavity 11. This prevents or reduces the probability of any pressure on the underside of the tray accidentally pushing the medication through the cover sheet.

Figure 3:
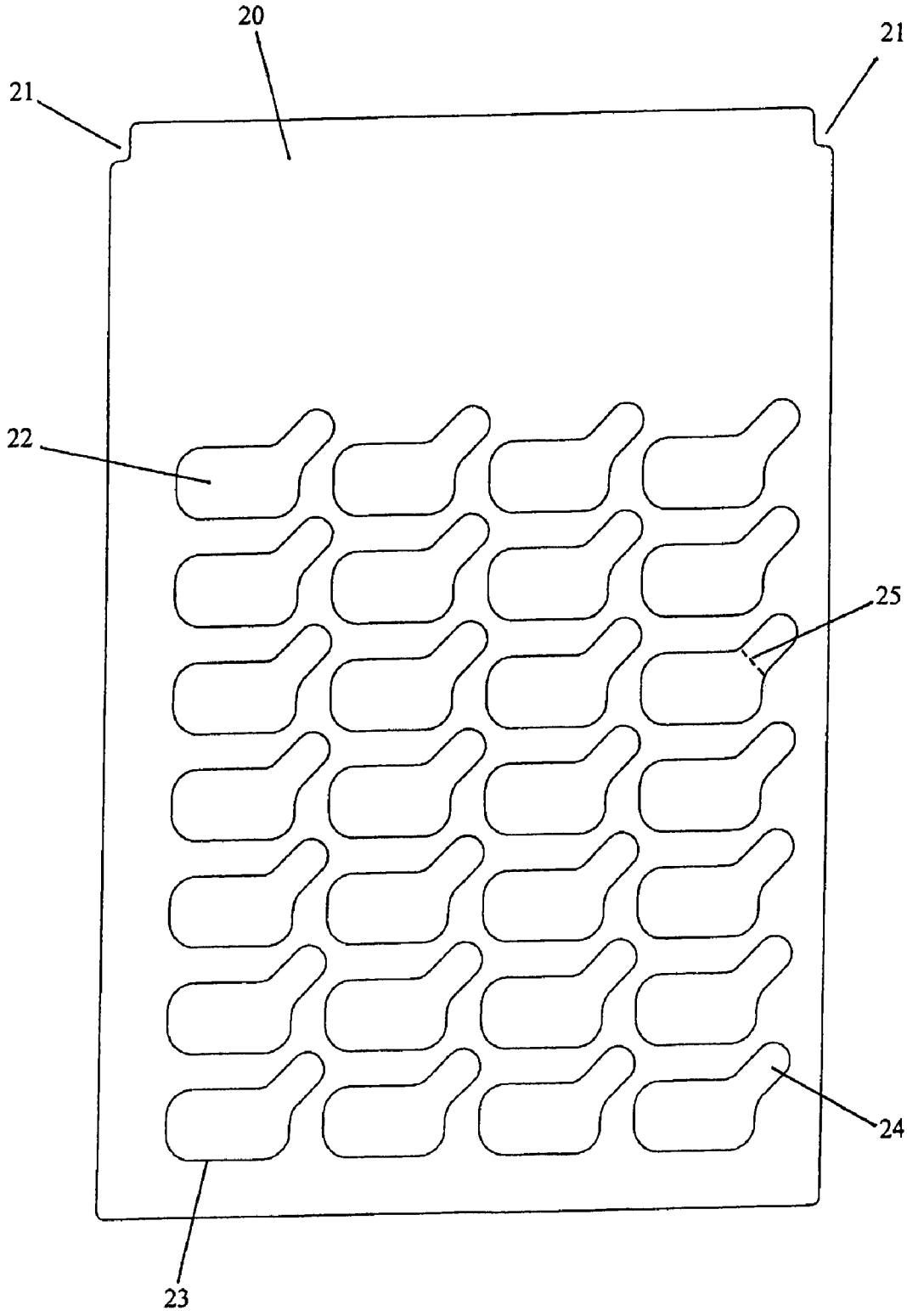
FIG. 3 illustrates a plan view of a cover film for use with the tray of FIGS. 1 and 2 to create a multiple-compartment container in accordance with an embodiment of the presently described invention.
Figure 4:
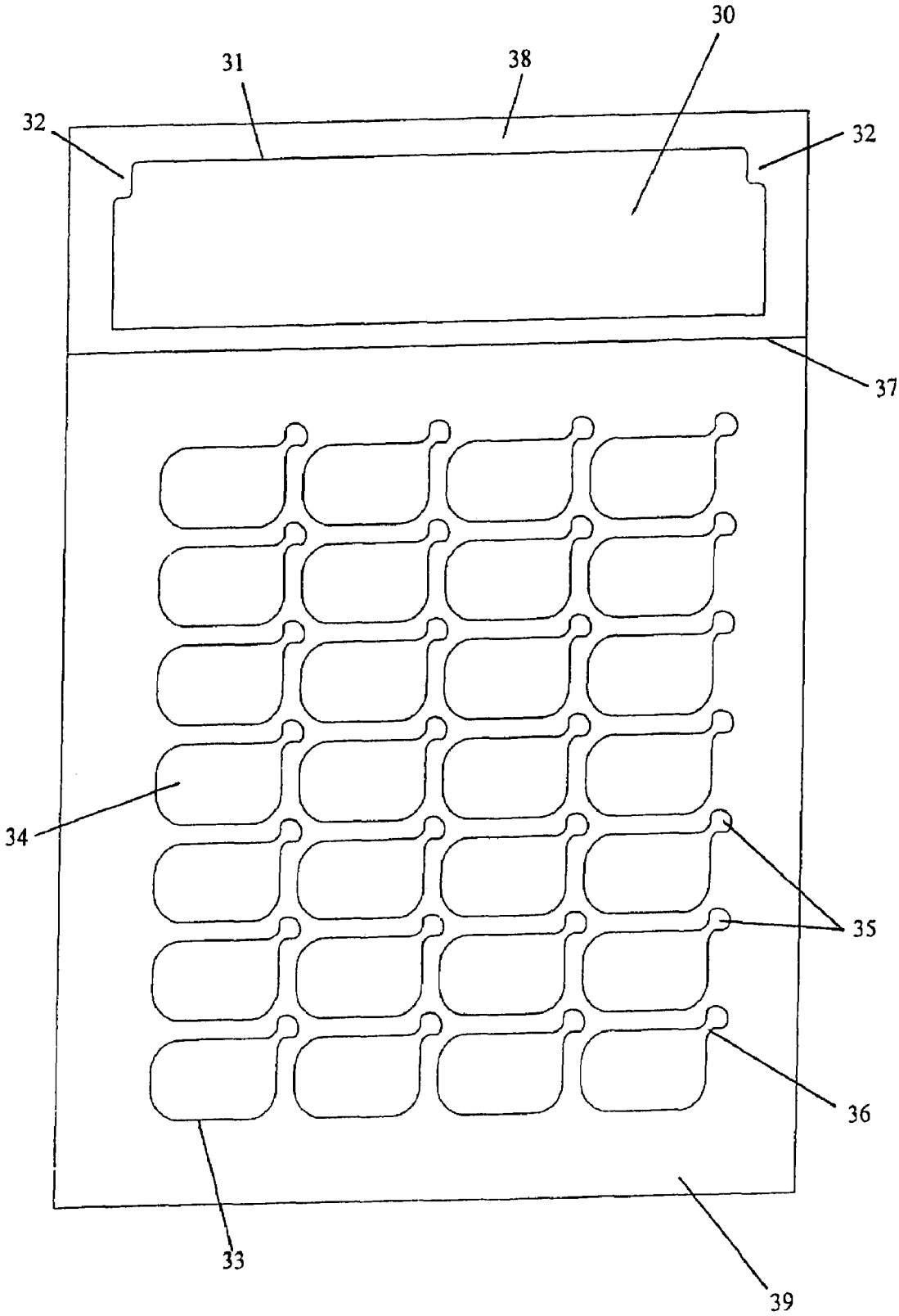
FIG. 4 illustrates a plan view of a sheet of barrier film to be used in conjunction with the cover sheet of FIG. 3 in the creation of a multiple-compartment container in accordance with an embodiment of the presently described invention.
Figure 5:
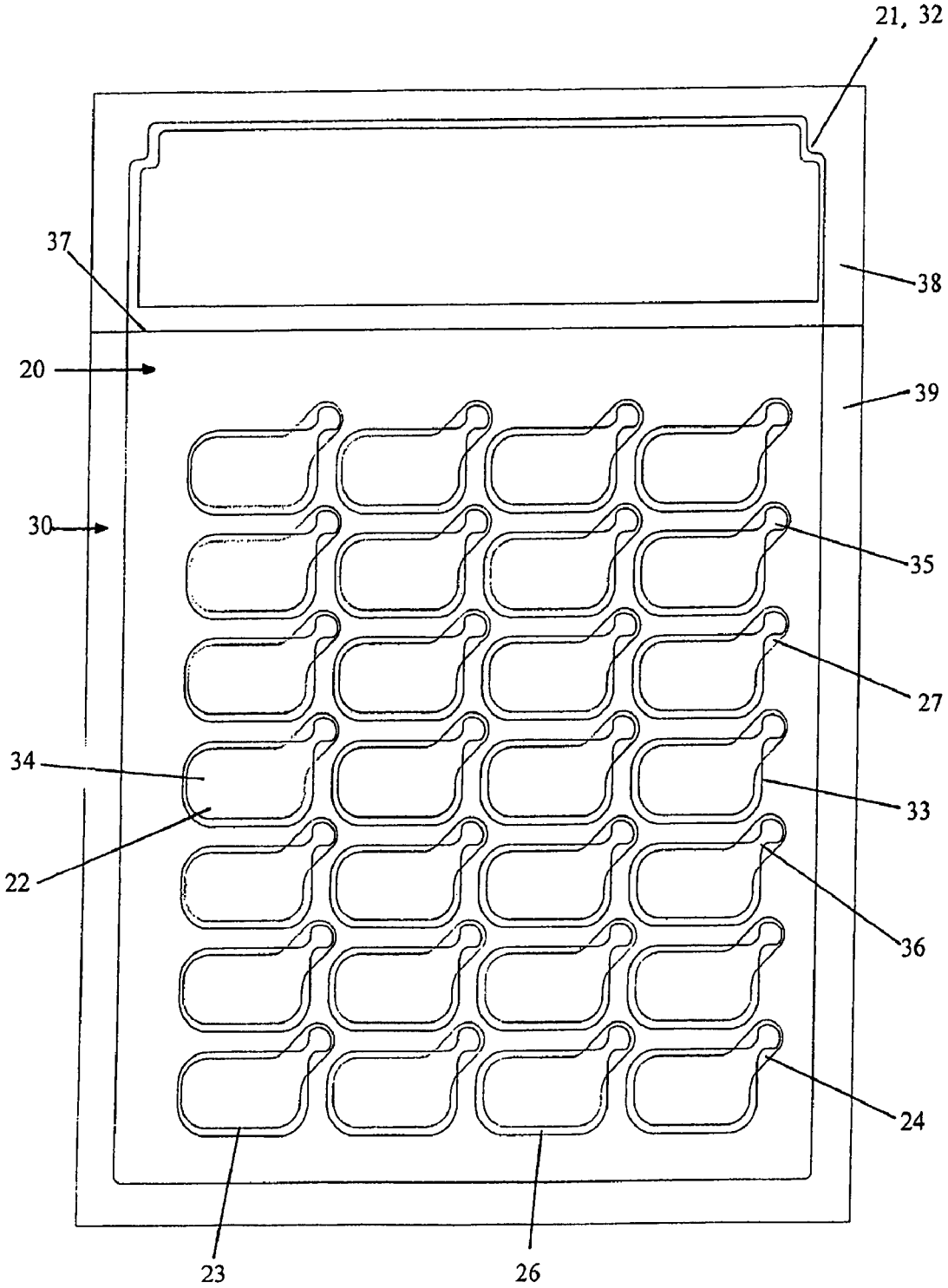
FIG. 5 illustrates a plan view of the sheet of barrier film of FIG. 4 applied to the underside of the cover sheet of FIG. 3 prior to the assembly of the multiple-compartment container in accordance with an embodiment of the presently described invention.

The cover sheet is of a laminated construction, which can be best understood by reference to FIGS. 3 to 5. The top surface of the cover sheet is the sheet 20 shown in FIG. 3. It is a sheet of smooth and flexible, and preferably transparent, plastics film, the outline of which corresponds to the outline shape of the upper part of the tray 1 with which it is to be used. A pair of location rebates 21 formed in the sheet 20 are precisely aligned with the location brackets 9 of the tray 1 for accurate location of the sheet 20 on the tray 1 in precise alignment one with the other.

The sheet 20 comprises a 4×7 array of tear-off portions 22 each of which is defined by a peripheral score line 23 and includes a lug portion 24. The score line 23 is a predefined zone of weakness in the film 20, which in use defines a preferred tear line in the plastics film. The score lines 23 could be replaced with pre-perforated lines or with cut lines that extend all of the way through the sheet 20.

In an embodiment, the entire underside of the sheet 20 of FIG. 3 is coated with a peelable adhesive, and the sheet 20 is, prior to use, adhered to a barrier sheet 30 as shown in FIG. 4. A suitable construction would be a polypropylene cover sheet that is 60 micron thick, a peelable adhesive layer that is 20 micron thick and a polypropylene barrier sheet that is 50 micron thick. Other constructions are possible and within the scope of the presently described invention. The barrier sheet 30 has a score line 31 defining two locating rebates 32, which in use register with the locating rebates 21 of the sheet 20. Score lines 33 define the outer peripheries of a 4×7 array of vapor-impermeable patches 34, which in use are adhered to the respective tear-off portions 22 of FIG. 3 and lie directly over the respective cavities 6 of FIGS. 1 and 2. The score lines 33 could also be replaced with pre-perforated lines or with cut lines that extend all of the way through the barrier sheet 30. Each vapor-impermeable patch 34 is joined to a reinforcement patch 35 by means of a flexible bridge portion 36. The reinforcement patches 35 in use adhere to the undersides of the lugs 24 of FIG. 3 to reinforce and stiffen the lugs. The vapor-impermeable patches 34 are larger than the tear-off portions 22 but the reinforcement patches 35 are the same size or slightly smaller than the lugs 24.

It can be clearly seen from FIG. 5 that when the plastics film sheet 20 of FIG. 3 is placed over the sheet 30 of the barrier film of FIG. 4 and adhered to the barrier sheet 30 with the locating rebates 21 and 32 in register, each tear-off portion 22 has a patch 34 with low vapor transmission properties and a reinforcing patch 35 under each lug 24.

A further score line 37 is formed across the top of the barrier sheet, beneath the locating rebates 32, to define a tear-off strip 38 along the top edge of the barrier sheet 30.

In use, a pharmacist or a carer, or the patient himself or herself can distribute medication in the form of tablets and/or capsules between the 28 cavities 6 of the tray 1 in accordance with a 7-day or 28-day regimen. For example, the seven rows of cavities 6 can represent the seven days of the week, and the four columns can represent either four consecutive weeks of a 28 day dosage cycle, or four different dosage times for each day of treatment. In the latter case, the first column can represent breakfast, the second column lunchtime, the third column early evening and the fourth column bedtime. Either a uniform medication can be distributed through the 28 cavities, or a varying mixture of medications can be put into each cavity.

When the cavities have been properly filled, the assembled cover sheet and backing sheet of FIG. 5 can be placed over the tray and aligned with the tray by placing the locating rebates 21 and 32 of the cover sheet and backing sheet next to the location brackets 9 of the tray. Holding the cover sheet and backing sheet 20, 30 in position with one hand, the tear-off strip 38 of the backing sheet can be pealed away, with the rebates 21 in the cover sheet 20 returning to locate adjacent the location brackets 9 to maintain the alignment of the cover sheet 20 over the tray. The adhesive on the underside of the cover sheet 20 firmly anchors the top edge of the cover sheet 20 to the tray 1. At that stage, without moving the tray 1 and without disturbing the contents of the cavities 6, a main portion 39 of the barrier film 30 can then be peeled away from under the cover sheet 20 so as to expose the adhesive on the underside of the cover sheet 20 and permit it to be adhered to the generally planar top surface 5 of the tray 1. During the peeling away of the main portion 39, the barrier sheet 30 tears around the score lines 33, leaving the patches 34 and 35 still adhered to the underside of the cover sheet 20.

As the cover sheet 20 is smoothed down and adhered to the substantially planar top surface 5 of the tray 1, the lugs 24 come into contact with the rigid protrusions 7 of the tray. The contact between the rigid protrusions 7 and the overlying lugs 24 as the cover sheet 20 is smoothed down causes the score lines 23 to tear around the lugs and the lugs are flexed upwardly around zones of flexure or hinge areas 25 (one of which is shown dotted in FIG. 3). The flexible bridges 36 also allow the reinforcing patches 35 to flex upwardly with the lugs 24. The lug portions 24 are thus bent upwardly out of the plane of the remainder of the cover film 20 by the rigid protrusions 7 so that they can very easily be grasped between thumb and forefinger when the time is right to remove the associated tear-off portion 22 and dispense the medication in the associated cavity. The reinforcing patch 35 beneath each lug 24 stiffens the lug 24 and helps the stiffened lug to point upwardly at an angle to the remainder of the cover film 20 even when the edge of each lug 24 remote from its associated tear-off portion 22 extends in cantilever beyond the edge of the associated protrusion 7 as clearly shown in FIG. 6.

In an embodiment of the presently described invention, the tear-off portions 22 and the vapor-impermeable patches 34 are not adhered to the substantially planar top surface 5 of the tray but are held in place by the periphery of the cover sheet 20.

In an embodiment, the multi-compartment container incorporates a tamper-evident feature to make sure that no one can interfere with the stored medication before it is properly dispensed. The tamper-evident feature arises from the fact that the vapor-impermeable patches 34 are larger than the tear-off portions 22. When a lug portion 24 is grasped between thumb and forefinger, the reinforcing patch 35 will also be grasped. Further movement of the lug portion 24 away from the generally planar top surface 5 of the tray 1 will cause the score line 23 in the cover sheet 20 to break and free the tear-off portion 22. However, to fully release the tear-off portion 22, the vapor-impermeable patch 34 must also be peeled away from the overlapping region 26 of the cover sheet 20 surrounding the tear-off portion 22 (see FIG. 5). Once the tear-off portion 22 and vapor-impermeable patch 34 are completely removed, the overlapping region 26 of the cover sheet 20 will, in practice, adhere to the generally planar top surface 5 of the tray of its own accord. It will therefore be appreciated that the tear-off portion 22 cannot be reattached to the tray 1 because the vapor-impermeable patch 34 which is adhered to the underside of the tear-off portion 22 is larger than the aperture overlying the cavity 6 and it is difficult, if not impossible to slide the vapor-impermeable patch back between the cover sheet 20 and the tray 1 because the overlapping region 26 will have adhered itself to the generally planar top surface 5 of the tray 1. The score lines 23 define a periphery of the tear-off portions 22 which is the same size, or slightly smaller, than the opening of the cavities 6 in the tray. Therefore, even if the vapor-impermeable patch 34 is peeled away from the tear-off portion 22, there is nothing to adhere the tear-off portion to.

It can be seen from FIG. 3 that the flexible bridges 36 which connect the reinforcing patches 35 to the vapor-impermeable patches 34 are narrow in comparison to the lug portions 24 of the tear-off portions 22. This means that a portion 27 of the underside of the lug portions 24 can be adhered to the planar top surface 5 of the tray 1. This does not prevent the lugs 24 from being able to flex upwardly out of the plane of the remainder of the cover sheet 20 but helps to reduce or eliminate any vapor penetration under the reinforcing patches 35 of the backing sheet 22 and into the cavities 6.

Printed instructions to the user concerning the timing of the different cavities can be printed on the tray 1 or on the cover film 20 (if the cover film is transparent). In addition, printing to identify the manufacturer of the multiple-compartment container, the pharmacy, or the patient can be printed on the header portion 8 of the tray or on the cover film 20 which overlies that portion.

Pharmacy regulations may prohibit the removal of the tray 1 once it has been clipped to the U-shaped wire loop. Therefore, once the tear-off portion 24 has been removed, the medication stored within the particular cavity 6 can be easily dispensed by folding the upper part 2 of the tray over along the hinge 4 so that the array of cavities 6 are pointing downwards.

While particular elements, embodiments and applications of the presently described invention have been shown and described, it is understood that the presently described invention is not limited thereto since modifications may be made by those skilled in the technology, particularly in light of the foregoing teaching. It is therefore contemplated by the appended claims to cover such modifications and incorporate those features that come within the spirit and scope of the presently described invention.

The invention claimed is:

1. A container for storing and dispensing consumer products, comprising:

a tray having a generally planar top surface into which has been formed a plurality of discrete cavities;

consumer products disposed in one or more of the discrete cavities; and a cover sheet secured to the generally planar top surface of the tray, the cover sheet sealing the plurality of cavities and retaining the consumer products in one or more of the plurality of cavities, the cover sheet being arranged in a plane and having pre-formed separation lines defining a plurality of separatable portions corresponding to the peripheries of the plurality of cavities, each separatable portion being configured to retain the respective consumer products in the respective cavity until the separatab1e portion is removed, each separatable portion of the cover sheet having a respective associated lug portion that is not secured to the tray, each lug portion configured for gripping by a consumer preparatory to removing the respective separatable portion;

wherein the top surface of the tray has a plurality of rigid upwardly extending protrusions each positioned underneath a respective one of the lug portions and bending the respective lug portion upwardly out of the plane of the cover sheet.

2. A container according to claim 1, wherein the cover sheet is secured to the top surface of the tray by an adhesive.

3. A container according to claim 2, wherein the adhesive is a layer of peelable adhesive applied to the underside of the cover sheet.

4. A container according to claim 1, wherein an array of discrete cavities are formed into the generally planar top surface of the tray and the cover sheet has pre-formed tear lines defining the peripheries of an array of tear-off portions, each tear-off portion being arranged so that it lies over an associated one of the cavities.

5. A container according to claim 4, wherein the tear-off portions of the cover sheet have low vapor transmission properties in the areas which overlie the cavities, the low vapor transmission properties being created by patches with high vapor barrier properties shaped and sized to overlie the cavities and adhered to the underside of the cover sheet by a layer of peelable adhesive.

6. A container according to claim 5, wherein the patches extend under the lug portions and are adhered to the underside of the lug portions by a layer of peelable adhesive.

7. The container according to claim 5, wherein the cover sheet is secured to the top surface of the tray by a layer of peelable adhesive and the patches are adhered to the underside of the cover sheet by the same layer of peelable adhesive.

8. The container according to claim 6, wherein the cover sheet is secured to the top surface of the tray by a layer of peelable adhesive and the pails of the patches that extend under the lug portions are adhered to the underside of the lug portions by the same layer of peelable adhesive.

9. A container according to claim 1, wherein the tray has upstanding cover sheet location means formed there on, and the cover sheet has cooperating means for accurate location of the cover sheet over the tray with the tray cavities and cover sheet tear-off portions in register.

10. A container according to claim 1, wherein the separatable portions of the cover sheet have selected transmission properties in the areas which overlie the cavities, the selected transmission properties being created by patches with barrier properties shaped and sized to overlie the cavities and adhered to the underside of the cover sheet by a layer of peelable adhesive.

11. A container according to claim 1, wherein the separatable portions of the cover sheet have patches shaped and sized to overlie the cavities and adhered to the underside of the cover sheet by a layer of peelable adhesive.

12. A container according to claim 1, wherein the cover sheet is a metal foil, a metallized polymeric film or paper sheet, or a plastics film of single or multiple layer construction.

13. A container according to claim 1, wherein the cover sheet is non-rupturable.

14. A container according to claim 1, being a multiple-compartment container for containing and dispensing medication according to a pre-defined dosage regimen.

15. A container for storing and dispensing consumer products, comprising:

a tray having a generally planar top surface into which has been formed a plurality of discrete cavities for receiving the consumer products; and a cover film to be secured to the generally planar top surface of the tray to seal the plurality of cavities to retain the consumer products in the plurality of cavities;

the cover film having pre-formed tear lines defining a tear-off portions corresponding to the periphery of one or more of the plurality of cavities to retain the consumer products in one or more respective cavities until the respective tear-off portion is removed by tearing along its tear lines, each respective tear-off portion of the cover film having a respective associated lug portion not secured to the tray in use, for gripping by a consumer preparatory to tearing off the respective tear-off portion;

characterised in that the top surface of the tray has a rigid upwardly extending protrusion positioned to be located underneath each respective lug portion in use to bend that lug portion upwardly out of the plane of the remainder of the cover film when the cover film is secured to the generally planar top surface of the tray to retain the consumer products in the plurality of cavities, wherein the cover film is secured to the top surface of the tray by an adhesive, wherein the adhesive is a layer of peelable adhesive applied to the underside of the cover film, wherein the tear-off portions of the cover film have low vapor transmission properties in the areas which in use overlie the cavities, those low vapor transmission properties being created by patches with high vapor barrier properties shaped and sized to overlie the cavities and adhered to the underside of the cover film by the same layer of peelable adhesive as that which in use adheres the cover film to the top surface of the tray, and wherein the patches are larger than the tear-off portions.

16. A container according to claim 15, wherein the patches overly a region of the generally planar top surface of the tray extending around the peripheries of the cavities.

17. A container for storing and dispensing consumer products, comprising:

a tray having a generally planar top surface into which has been formed one or more discrete cavities for receiving the consumer products; and a cover film to be secured to the generally planar top surface of the tray to seal the one or more cavities to retain the consumer products in the one or more cavities;

the cover film having pre-formed tear lines defining a tear-off portion corresponding to the periphery of one or more cavities to retain the consumer products in the respective cavity until the tear-off portion is removed by tearing along its tear lines, the respective tear-off portion of the cover film having a respective associated lug portion not secured to the tray in use, for gripping by a consumer preparatory to tearing off the respective tear-off portion;

characterised in that the top surface of the tray has a rigid upwardly extending protrusion positioned to be located underneath the respective lug portion in use to bend that lug portion upwardly out of the plane of the remainder of the cover film when the cover film is secured to the generally planar top surface of the tray to retain the consumer products in the one or more cavities;

wherein the cover film is secured to the top surface by an adhesive, wherein the adhesive is a layer of peelable adhesive applied to the underside of the cover film;

wherein the respective tear-off portion of the cover film has low vapor transmission properties in the area which in use overlies the associated cavity, those low vapor transmission properties being created by a respective patch with high vapor barrier properties shaped and sized to overlie the associated cavity and adhered to the underside of the cover film by the same layer of peelable adhesive as that which in use adheres the cover film to the top surface of the tray, and wherein the respective patch is larger than the respective tear-off portion.

18. A container according to claim 17, wherein the respective patch overlies a region of the generally planar top surface of the tray extending around the periphery of the associated cavity.

19. A container for storing and dispensing consumer products, comprising:

a tray having a generally planar top surface into which has been formed a plurality of discrete cavities;

consumer products disposed in one or more of the discrete cavities; and a cover sheet secured to the generally planar top surface of the tray, the cover sheet sealing the plurality of cavities and retaining the consumer products in one or more of the plurality of cavities, the cover sheet being arranged in a plane and defining a plurality of separatable portions, one per cavity, each separatable portion being configured to retain the respective consumer products in the respective cavity until the separatable portion is removed, each separatable portion of the cover sheet having a respective associated lug portion that is not secured to the tray, each lug portion configured for gripping by a consumer preparatory to removing the respective separatable portion;

wherein the top surface of the tray has a plurality of rigid upwardly extending protrusions each positioned underneath a respective one of the lug portions and bending the respective lug portion upwardly out of the plane of the cover sheet.

20. A container for storing and dispensing consumer products, comprising:

a tray having a generally planar top surface into which has been formed a plurality of discrete cavities;

consumer products disposed in one or more of the discrete cavities; and a cover sheet secured to the generally planar top surface of the tray, the cover sheet sealing the plurality of cavities and retaining the consumer products in one or more of the plurality of cavities, the cover sheet being arranged in a plane and defining a plurality of removable portions, one per cavity, each removable portion being configured to retain the respective consumer products in the respective cavity until the removable portion is removed, each removable portion of the cover sheet having a respective associated lug portion that is not secured to the tray, each lug portion configured for gripping by a consumer preparatory to removing the respective removable portion;

wherein the top surface of the tray has a plurality of rigid upwardly extending protrusions each positioned underneath a respective one of the lug portions and bending the respective lug portion upwardly out of the plane of the cover sheet.

21. A container system for storing and dispensing consumer products, comprising:

a tray comprising a generally planar top surface into which has been formed a plurality of discrete cavities for retaining consumer products, a plurality of rigid upwardly extending protrusions extending from the generally planar top surface;

a cover sheet configured to be secured to the generally planar top surface of the tray to seal the plurality of cavities, the cover sheet being arranged in a plane and comprising a plurality of separation lines defining a plurality of removable portions tat corresponds to the number of cavities of the plurality of cavities of the tray, each removable portion of the cover sheet having a respective associated lug portion also defined by the separation lines and configured for gripping by a consumer preparatory to removing the respective removable portion when the cover sheet is adhered to the generally planar top surface of the tray, the cover sheet comprising a peelable adhesive on a bottom surface thereof, the peelable adhesive being configured to adhere the cover sheet to the generally planar top surface of the tray and to a barrier film; and a barrier film configured to be secured to the peelable adhesive of the cover sheet, the barrier film comprising a plurality of separation lines defining a plurality of removable portions that correspond to the number of cavities of the plurality of cavities of the tray;

wherein each of the plurality of rigid upwardly extending protrusions is positioned to be oriented underneath a respective one of the lug portions when the cover sheet is adhered to the generally planar top surface of the tray.

22. The container system of claim 21, wherein the tray comprises location brackets, the cover sheet comprises location rebates configured to be received by the location brackets, and the barrier film comprises location rebates configured to be received by the location brackets.

23. A container for storing and dispensing consumer products, comprising:

a tray having a generally planar top surface into which has been formed one or more discrete cavities for receiving consumer products;

a cover sheet secured to the generally planar top surface of the tray to seal the one or more cavities to retain the consumer products in the one or more cavities, the cover sheet comprising a removable portion defined by a separation line and corresponding to the periphery of one or more of the cavities, the removable portion being configured to retain the consumer products in a respective one of the one or more cavities until the removable portion is removed, the removable portion having an associated lug portion that is not to be secured to the tray, and the lug portion being configured for gripping by a consumer preparatory to removing the removable portion; and a patch having barrier properties and being shaped and sized to overlie the same cavity to which the removable portion corresponds;

wherein the top surface of the tray has a rigid upwardly extending protrusion positioned underneath the lug portion for bending the lug portion upwardly away from the plane of the generally planar top surface, the cover sheet is scored to the top surface of the tray by an adhesive comprising a layer of peelable adhesive applied to the underside of the cover sheet, the removable portion and patch provide selected transmission properties in the area overlying the associated cavity, the patch is adhered to the underside of the cover sheet by the same layer of peelable adhesive that adheres the cover sheet to the top surface of the tray, and the patch is larger than the respective removable portion.

24. The container of claim 23, wherein the separation line comprises a tear line.

25. The container of claim 23, wherein the separation line comprises a score line.

26. The container of claim 23, wherein the separation line comprises a cut line.

27. The container of claim 23, wherein the separation line comprises a combination, and the combination comprises a combination of different members selected from the group consisting of a tear line, a score line, and a cut line.

* * * * *